United States Patent [19]

Yoshikawa et al.

[11] Patent Number: 4,891,952

[45] Date of Patent: Jan. 9, 1990

[54] FREEZER-REFRIGERATOR

[75] Inventors: Masaharu Yoshikawa, Kashihara; Kazuo Sugimoto, Osaka; Masuo Kamitaka, Nara; Shinya Takagi, Nara; Hiroyuki Yoshida, Nara, all of Japan

[73] Assignee: Sharp Kabushiki Kaisha, Osaka, Japan

[21] Appl. No.: 188,535

[22] Filed: Apr. 29, 1988

[30] Foreign Application Priority Data

| | | | |
|---|---|---|---|
| Jul. 22, 1987 | [JP] | Japan | 62-184132 |
| Oct. 20, 1987 | [JP] | Japan | 62-160682[U] |
| Nov. 17, 1987 | [JP] | Japan | 62-289900 |
| Nov. 30, 1987 | [JP] | Japan | 62-304151 |
| Dec. 8, 1987 | [JP] | Japan | 62-187049[U] |
| Dec. 15, 1987 | [JP] | Japan | 62-317755 |

[51] Int. Cl.[4] ..... F25B 5/00; F25D 17/00

[52] U.S. Cl. ..... 62/199; 62/157; 62/180; 62/272

[58] Field of Search ..... 62/157, 231, 198, 199, 62/200, 180, 186, 226, 227, 272; 165/133

[56] References Cited

U.S. PATENT DOCUMENTS

| | | | |
|---|---|---|---|
| 2,128,020 | 8/1938 | Smilack | 62/199 |
| 3,125,866 | 3/1964 | Mann et al. | 62/272 |
| 4,470,203 | 9/1984 | Bradley et al. | 62/64 X |
| 4,499,738 | 2/1985 | Motoyama et al. | 62/157 X |
| 4,513,581 | 4/1985 | Mizobachi et al. | 62/197 |
| 4,537,041 | 8/1985 | Denpou et al. | 62/199 |
| 4,697,429 | 10/1987 | Chandler et al. | 62/231 X |

*Primary Examiner*—Harry B. Tanner

*Attorney, Agent, or Firm*—Birch, Stewart, Kolasch & Birch

[57] ABSTRACT

A refrigerator comprising a refrigeration cycle which comprises a compressor, condenser, first capillary tube and first cooler connected into a loop, and a quick freezing refrigerant circuit connected in parallel with the first cooler and comprising a second capillary tube and a second cooler connected in series therewith. The refrigerant is passed through the first cooler for usual operation, or alternatively through the quick freezing circuit for quick freezing. During quick freezing, the first cooler is held out of operation, and the refrigerant has its pressure reduced in two steps by the first and second capillary tubes and is evaporated in the second cooler only, giving a low temperature effective for quick freezing. During usual operation, no refrigerant flows into the second cooler, which therefore remains free of frosting. The frost deposited on the second cooler during quick freezing disappears during the usual operation. Thus, the second cooler is substantially free from frost.

30 Claims, 12 Drawing Sheets

FREEZER-REFRIGERATOR

BACKGROUND OF THE INVENTION

1. Field of the Invention

The present invention relates to refrigerators having a quick freezing function.

2. Description of the Prior Art

With greater attention directed to home freezing in recent years owing to diversified dietary habits, it has become desirable for household refrigerators to have a quick freezing function.

Common fan-type freezer-refrigerators include a loop of compressor, a condenser, a capillary tube and cooler, but include no specific expedient in its cycle for quick freezing. When such a refrigerator is used for this purpose, the compressor is continuously operated for a given period of time disregarding the signal of the thermostat for detecting the temperature of the freezer compartment to lower the temperature of the freezer compartment, i.e. the temperature of cold air forced out through the cooler, to the greatest possible extent and thereby expedite freezing.

During quick freezing, however, the cycle itself operates in the usual mode, with the compressor merely held in continuous operation, so that there is a limitation to the reduction of temperature of the cooler or freezer compartment. Moreover, freezing is effected primarily with cold air, therefore involves a small heat transfer coefficient and cannot be expedited greatly as expected. Accordingly, several refrigeration cycles have been proposed which are adapted for quick freezing.

For example, Unexamined Japanese Patent Publication SHO 55-121369 discloses a refrigeration circuit which includes a first capillary tube, a first cooler, a series circuit of second capillary tube and second cooler provided therebetween, and an electromagnetic valve connected in parallel with the series circuit. The valve is opened for usual operation or is closed for quick freezing. More specifically, when the electromagnetic valve is open, the refrigerant almost wholly flows through the valve owing to the resistance of the second capillary tube without allowing the second cooler to perform a substantial cooling function, whereas when the valve is closed, the refrigerant flows through the first and second capillary tubes and is thereby throttled in two steps, causing the second cooler to function along with the first to give a lower temperature. The second cooler is generally in the form of a direct cooling plate of metal, and food is placed directly on the plate and thereby frozen quickly through improved heat transfer. The refrigerant flowing out of the condenser is throttled in two steps by the first and second capillary tubes for rapid freezing and consequently affords a lower temperature on evaporation than in the usual operation. Nevertheless, since the refrigerant passes through both the second and first coolers, the evaporators combined have a larger area of heat transfer, which makes it impossible to obtain an extremely low temperature.

Unexamined Japanese Patent Publication SHO 56-37475 proposes a cycle which comprises a first capillary tube, a second cooler, a parallel circuit of second capillary tube and first cooler provided therebetween, and an electromagnetic valve connected in series with the first cooler. The valve is opened for usual operation or is closed for quick freezing. When the valve is open, the refrigerant from the first capillary tube flows through the first and second coolers, while with the valve closed, the refrigerant is throttled in two steps by the first and second capillary tubes and then evaporates only at the second cooler, which therefore gives a temperature as low as about −50° C. Thus, the cycle is useful for quick freezing. However, the refrigerant flows through both the first and second coolers during usual operation, so that the second cooler also becomes frosted which is generally in the form of a direct cooling plate installed in the freezer compartment. Accordingly, the cycle has the drawback that the second cooler can not be automatically defrosted but must be manually defrosted after removing the contents of the compartment therefrom.

SUMMARY OF THE INVENTION

The present invention provides a freezer-refrigerator which comprises a storage compartment; a freezer compartment; a refrigeration cycle comprising a compressor, a condenser, a first capillary tube and a first cooler connected with a refrigerant channel into a loop for circulating a refrigerant therethrough; a quick-freezing refrigerant circuit connected in parallel with the first cooler and comprising a second capillary tube and a second cooler connected in series therewith; the circuit having a junction for connection to the refrigerant channel from the first capillary tube to the first cooler; a change-over valve provided in the refrigerant channel between the junction and the first cooler for changing the flow of the refrigerant from the first cooler to the second cooler; a fan for supplying air cooled by the first cooler to the storage compartment and to the freezing compartment; and control means for driving the compressor, the fan and the change-over valve; the second cooler being disposed within the freezer compartment, the refrigerant being supplied to the first cooler for usual refrigeration to cool the storage compartment and the freezer compartment, the refrigerant being supplied to the second cooler for quick freezing to freeze the article to be frozen in contact with the second cooler.

The main object of the present invention is to provide a refrigerator which is adapted to refrigerate the interior thereof with air chilled by a first cooler and to give a low temperature of about −55° C. (−67° F.) by a second cooler for effective quick freezing. A further object of the present invention is to provide a refrigerator in which the second cooler is operable free of frost without necessitating any defrosting procedure.

DESCRIPTION OF THE PREFERRED EMBODIMENTS

Figure 1:
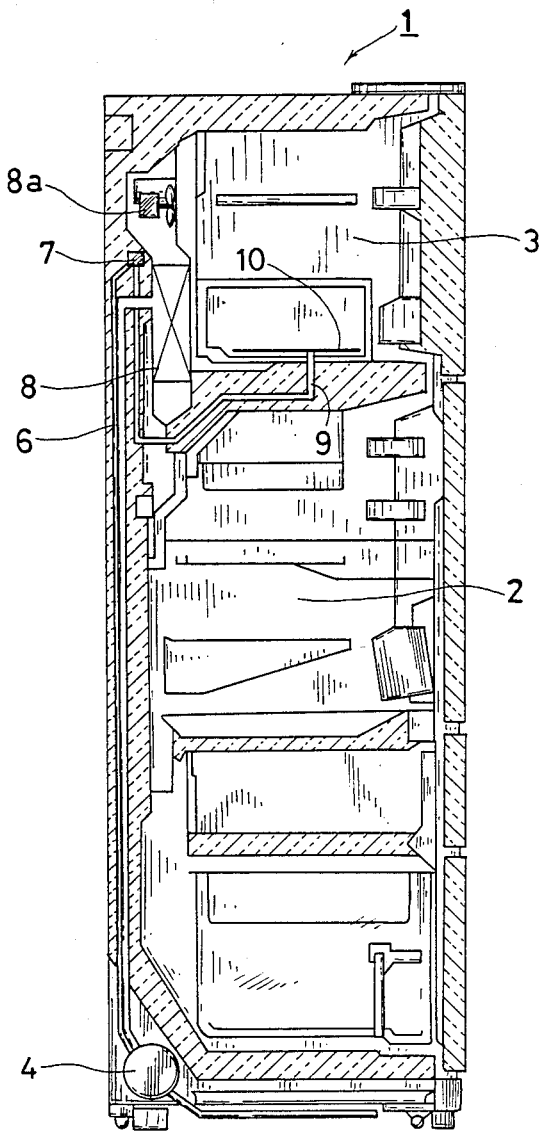
FIG. 1 is a sectional view showing a refrigerator embodying the invention.
Figure 2:
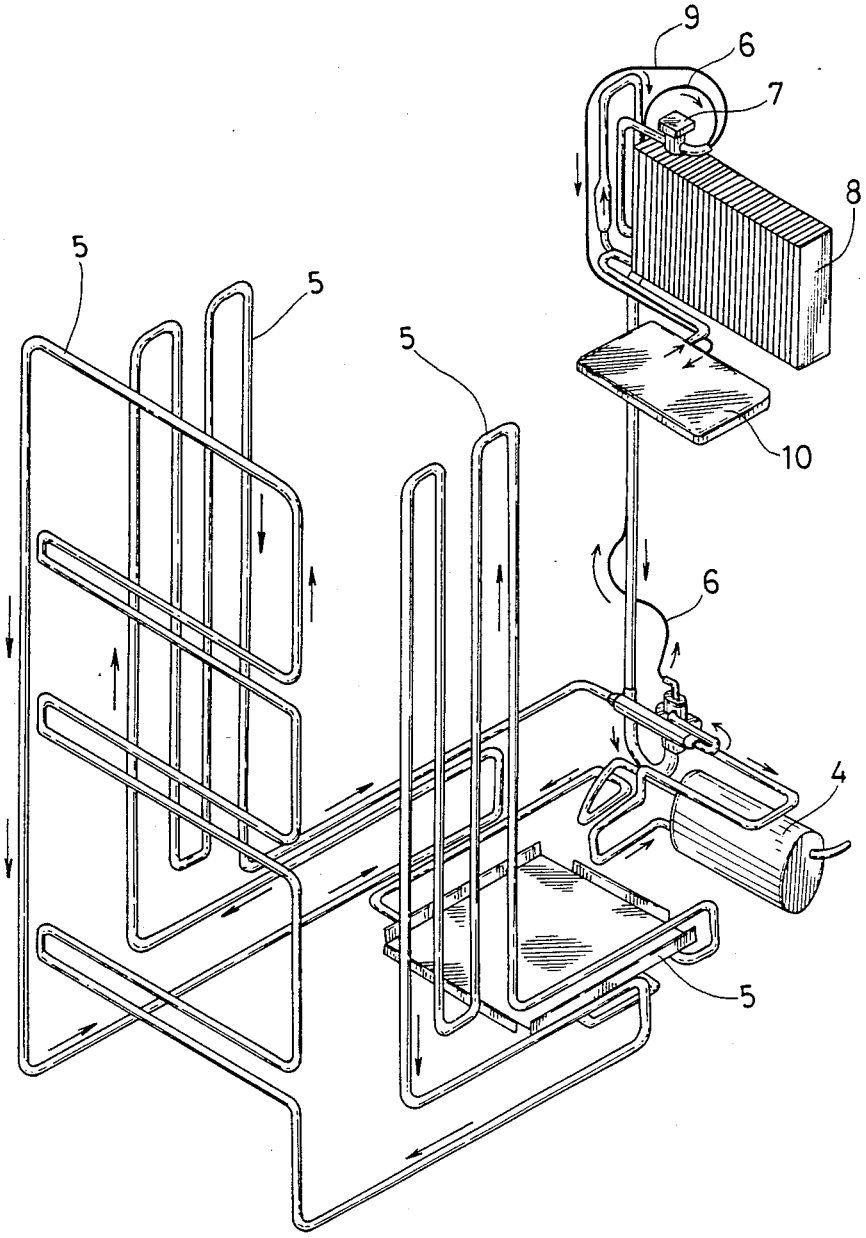
FIG. 2 is a perspective view showing the refrigeration cycle of the refrigerator of FIG. 1.
Figure 3:
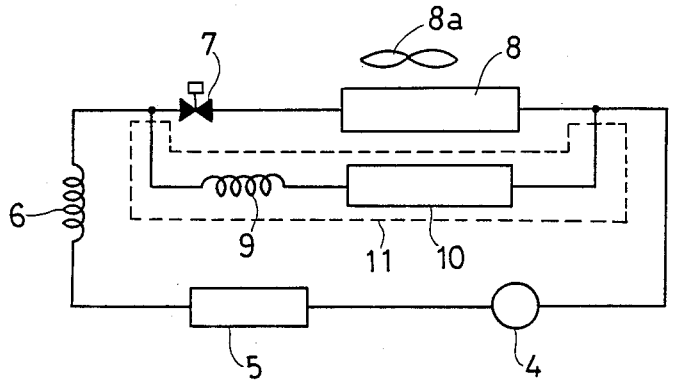
FIG. 3 is an equivalent circuit diagram of the refrigeration cycle.

First, the basic construction and operation of the refrigerator of the invention will be described. With reference to FIGS. 1 to 3, the illustrated refrigerator 1 has an overall capacity of 380 liters (13.4 $ft^3$), a storage compartment 2, and a freezer compartment 3 with a capacity of 88 liters (3.1 $ft^3$). The refrigerator 1 includes a refrigeration cycle comprising a compressor 4, a condenser 5, a first capillary tube 6, an electromagnetic valve 7 and a first cooler 8 which are connected into a loop. A quick freezing refrigerant circuit 11 comprising a second capillary tube 9 and a second cooler 10 connected in series therewith is connected in parallel with the valve 7 and the first cooler 8 at the inlet side of the former and at the outlet side of the latter. As is the case with common fan-type freezer-refrigerators, the first cooler 8 is a fin tube heat exchanger, in which a refrigerant is evaporated to cool air. The cold air is circulated through the refrigerator 1 by a fan 8*a* to refrigerate the freezer compartment 3 and the storage compartment 2. On the other hand, the second cooler 10 is a direct cooling plate comprising a metal sheet of aluminum or the like and a pipe arragned in a zigzag formation and joined to one face of the sheet. The second cooler 10 is installed in an interior portion of the freezer compartment or in a space specifically provided, on a flat surface. The second cooler 10 is adapted to directly chill the food to be frozen as placed thereon, and thus exhibits a greater heat transfer coefficient than the refrigeration with cold air and effects quick refrigeration and freezing. The lower normal temperature of the direct cooling plate, i.e. the second cooler 10, the higher is the rate of freezing of food.

With reference to the circuit of FIG. 3, when the electromagnetic valve 7 is open for usual operation, the vapor of refrigerant compressed to a high temperature and a high pressure by the compressor 4 is condensed by the condenser 5 to a liquid of high pressure, releasing heat. The liquid refrigerant is throttled to a reduced pressure by the first capillary tube 6, passes through the valve 7 in the form of a liquid-vapor two-phase flow of low pressure and enters the first cooler 8. The refrigerant deprives the air within the refrigerator of heat on evaporation and returns in the form of a vapor of low pressure to the compressor 4. At this time, almost no refrigerant flows into the quick freezing refrigerant circuit 11 owing to the resistance of the second capillary tube 9. The evaporation temperature of the refrigerant in the first cooler 8 is set at about −30° C. (−22° F.).

When the electromagnetic valve 7 is closed for quick freezing, the refrigerant in the two-phase state from the first capillary tube 6 is further throttled to a lower pressure by the second capillary tube 9 and evaporates in the second cooler 10, i.e. direct cooling plate, depriving food or the like placed thereon of heat. Thus, the refrigerant has its pressure reduced in two steps by the first and second capillary tubes 6 and 9 and evaporates in the second cooler 10. The evaporation temperature of the refrigerant in the second cooler 10 can be made a low value of about −55° C. (−67° C.) by suitably determining the throttling amount of the second capillary tube 9 and the size of the second cooler 10.

The second cooler 10 is likely to become frosted during the quick freezing operation, whereas this operation is conducted generally for a short period of time and does not result in the deposition of a large amount of frost. When the refrigerator resumes the usual operation, the first cooler 8 is operated alternatively, permitting the frost to spontaneously disappear from the second cooler 10 by sublimation without necessitating any defrosting procedure for the second cooler 10. The first cooler 8 can be automatically defrosted as is the case with common refrigerators.

Figure 4:
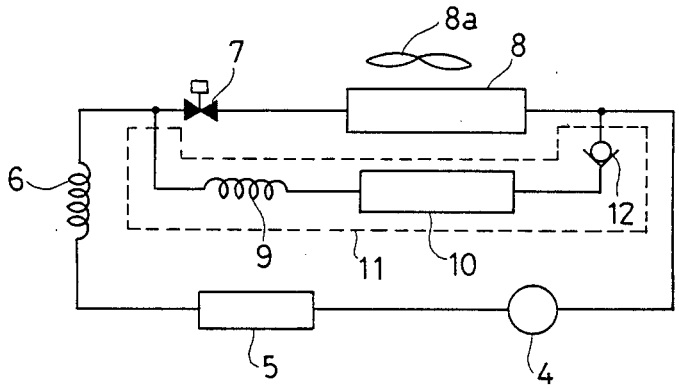
FIG. 4 is a diagram showing a modification of the equivalent circuit shown in FIG. 3.

The circuit of FIG. 4 comprises the circuit of FIG. 3 and is further provided at the outlet of the second cooler 10 with a check valve 12 for preventing the refrigerant from reversely flowing toward the outlet of the second cooler 10.

Stated more specifically, the first cooler 8, which is frosted during the usual operation, must be defrosted at a specified time interval. It is practice with common fan-type refrigerators to defrost the first cooler 8 by stopping the compressor 4 and energizing a heater attached to the underside of the first cooler 8 which is a fin tube heat exchanger. At this time, the refrigerant within the first cooler 8 heated evaporates to a vapor, which then flows into the second cooler 10 having the lowest temperature and condenses therein. If the defrosting time is long, therefore, the temperature of the second cooler 10 and the neighborhood thereof rises considerably, possibly exerting an adverse effect on the food placed on the second cooler 2 and in its vicinity.

The check valve 12 prevents the refrigerant from reversely flowing from the first cooler 8 toward the second cooler 10, thereby obviating the adverse effect on the food during defrosting.

Although a common two-way electromagnetic valve is used as the valve 7 in the above embodiments, a three-way electromagnetic valve may be provided at the junction between the first cooler 8 and the second capillary tube 9 to completely change over one circuit to the other. The two-way electromagnetic valve, when used as in the above embodiments, is preferably of such type that it is closed when energized to pass the refrigerant through the quick freezing circuit 11, so as to shorten the period of energization of the valve.

The second cooler 10 comprising a metal cooling plate for placing food directly thereon achieves improved heat transfer realizing quick freezing. However, if an individual's hand directly touches the cooling plate while handling the food, the water on the surface of the hand will freeze to hold the hand to the plate, possibly causing frostbite. Furthermore, the water released from the food is likely to freeze between the food and the cooling plate to make it difficult or impossible to remove the food from the plate. Accordingly, the surface of the cooler 10 to be left exposed in the freezer compartment 3 is coated with a deicing film of a water-repellent and ice-releasing resin, such as fluorocarbon resin (generally known by the brand name of Teflon) or silicone resin.

Figure 5:
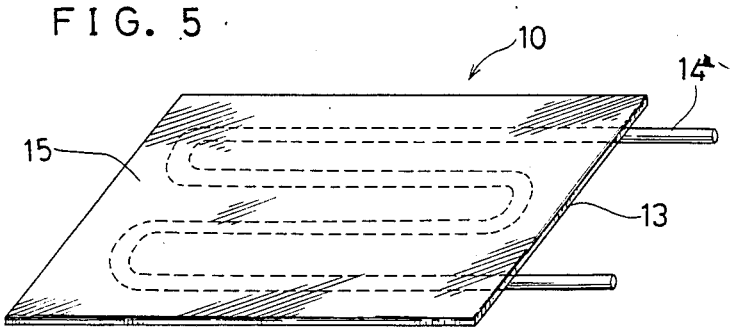
FIG. 5 is a perspective view showing a second cooler included in the refrigerator of FIG. 1.
Figure 6:
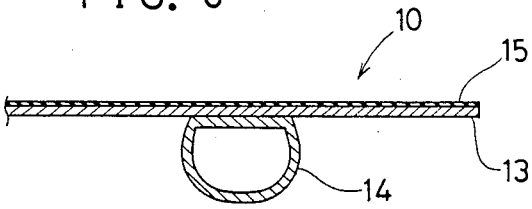
FIG. 6 is a fragmentary view in section of FIG. 5.

FIG. 5 is a perspective view showing the second cooler, and FIG. 6 is a fragmentary view in section showing the same. With reference to these drawings, the second cooler 10 comprises a metal sheet 13 which is usually made of aluminum or the like, a refrigerant tube 14 arranged in a zigzag fashion and joined to one surface of the sheet 13 as by brazing or welding, and a fluorocarbon or silicone resin film 15 coating the other surface of the sheet.

The surface of the fluorocarbon resin or silicone resin film is slippery, resistant to the adhesion of other substances, highly water-repellent and less prone to the deposition of frost or ice while readily releasing frost or ice. Accordingly, the hand is readily releasable from the cooling plate even if the water on the hand or fingers freezes upon the contact of the naked hand with the plate. Furthermore, the surface of the cooling plate, even if iced or frosted, can be easily deiced or defrosted with an external force without causing damage to the plate or raising the temperature of the plate.

Figure 7:
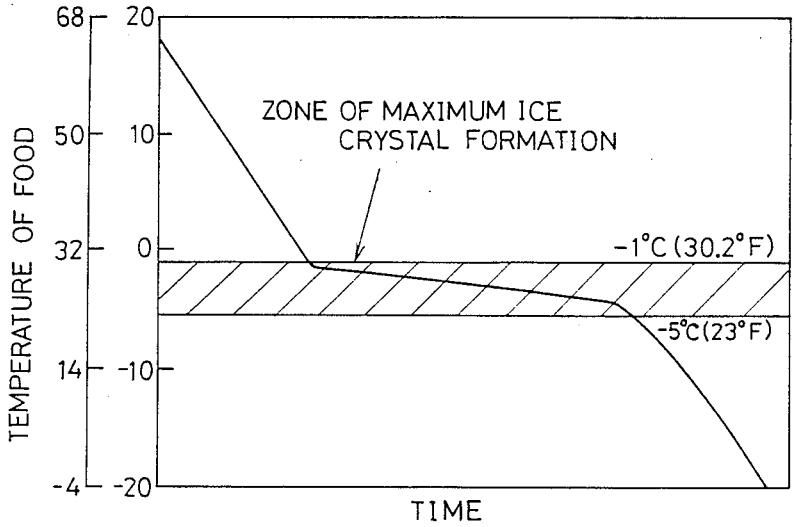
FIG. 7 is a graph showing variations with time in the temperature of the food being frozen.

Next, the quick freezing performance of the refrigerator shown in FIG. 1 will be described in detail. FIG. 7 shows the general form of freezing curve of food.

When food is to be frozen without impairing its taste, it is generally important to quickly pass the food through the temperature range of from −1° C. (30.2° F.) to −5° C. (23° F.), i.e., the so-called zone of maximum ice crystal formation, although the result achieved slightly differs from food to food, because if the passage through this zone requires a long period of time, cells of the food break to impair the foods quality. Ideally, therefore, when refrigerated in the zone of maximum ice crystal formation, the food is to be quick-frozen at cryogenic temperatures.

Table 1 shows the measurements of freezing time obtained when food (tuna or beef) was frozen as placed on the second cooler 10. During the pre-cooling time for decreasing the temperature of the food to −1° C. (30.2° F.), the electromagnetic valve 7 was held open to continuously refrigerate the food with the first cooler. During the freezing time for decreasing the temperature of the food from −1° C. (30.2° F.) to −5° C. (23° F.), the valve 7 was held closed to freeze the food with the second cooler.

TABLE 1

| Ambient temp. | | 30° C. (86° F.) | | 15° C. (59° F.) | |
|---|---|---|---|---|---|
| Food | | Tuna | Beef | Tuna | Beef |
| Weight | g | 380 | 400 | 420 | 400 |
| | (lb) | (0.84) | (0.88) | (0.93) | (0.88) |
| Thickness | mm | 18 | 18 | 25 | 20 |
| | (in) | (0.71) | (0.71) | (0.98) | (0.79) |
| Initial food temp. | °C. | 15.4 | 14.5 | 15.7 | 16.0 |
| | (°F.) | (59.7) | (58.1) | (60.3) | (60.8) |
| Pre-cooling time | min | 22 | 22 | 29 | 30 |
| Freezing time | min | 20 | 33 | 29 | 45 |
| Total freezing time | min | 42 | 55 | 58 | 75 |

Pre-cooling time: For temperature reduction from initial to −1° C. (30.2° F.)
Freezing time: For temperature reduction from −1° C. (30.2° F.) to −5° C. (23° F.)
Total freezing time: For temperature reduction from initial to −5° C.

Table 2 shows the measurements of freezing time (required for reducing the temperature of food from −1° C. to −5° C. obtained by quick freezing with the refrigerator of the invention and by freezing with a conventional refrigerator.

The results indicate that the present invention effects freezing within a much shorter period of time.

TABLE 2

| Food | | Freezing time (min) Quick freezing | Conventional freezer | Ratio |
|---|---|---|---|---|
| Raw beef steak | 400 g (0.88 lb) | 33 | 200 | 1/6 |

TABLE 2-continued

| Food | | Freezing time (min) Quick freezing | Conventional freezer | Ratio |
|---|---|---|---|---|
| Raw tuna steak | 400 g (0.88 lb) | 20 | 240 | 1/12 |
| Bamboo shoots (cut in round slices) | | 35 | 250 | 1/7 |
| Pork cutlet (one piece) | | 30 | 195 | 1/6.5 |

Freezing time: Time required for passage through the zone of maximum ice crystal formation (−1° C. (30.2° F.) to −5° C. (23° F.))

When the refrigeration cycle of FIG. 3 (or FIG. 4) is operated for quick freezing, the refrigerant flows through the second cooler (direct cooling plate) 10 to quickly freeze the food thereon, but no refrigerant flows through the first cooler 8, so that the temperature of the freezer compartment 3 and the storage compartment 2 gradually rises during the quick freezing period. Accordingly, the cycle can not be operated for a very long period of time in quick freezing. The period during which the refrigerant can be passed through the second cooler 10 while variations in the internal temperature of the refrigerator are maintained within a predetermined range is of course dependent on the capacity and construction of the refrigerator and the ambient temperature. When the allowable rise of internal temperature of the refrigerator shown in FIG. 1 is 2.5° C. (4.5° F.), it is required that the period be not greater than 30 minutes or 60 minutes at an ambient temperature of 30° C. (86° F.) or 15° C. (59° F.), respectively. In view of the above situation, therefore, the refrigerator of the invention must be equipped with a control system for operating the first and second coolers 8, 10 in good balance.

Some embodiments of control system for controlling the present refrigerator will be described next.

Figure 8:
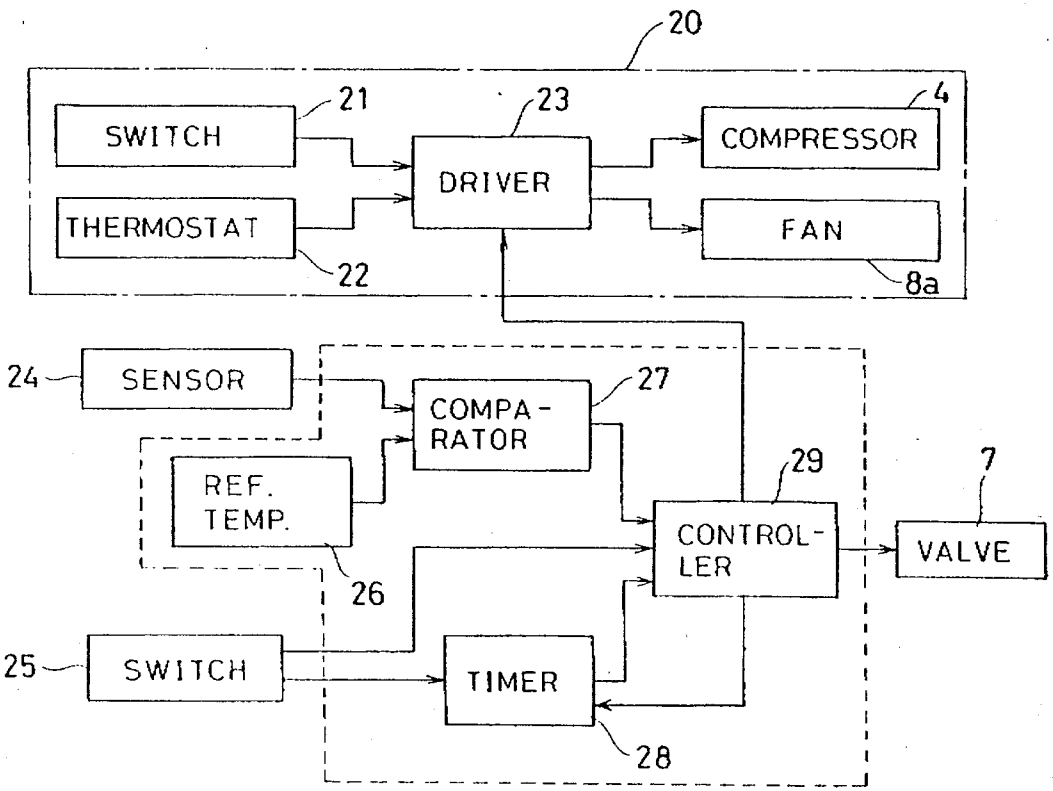
FIGS. 8, 12, 15 and 16 are block diagrams showing various embodiments of control system for the refrigerator of FIG. 1.
Figure 9:
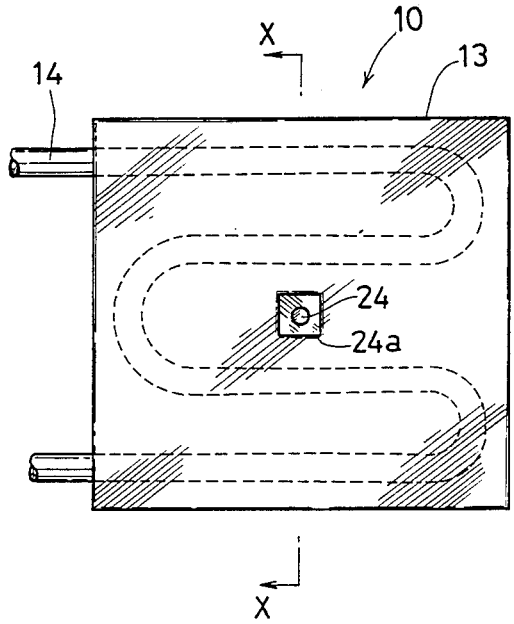
FIG. 9 is a diagram showing a temperature sensor as mounted on the second cooler of FIG. 5.
Figure 10:
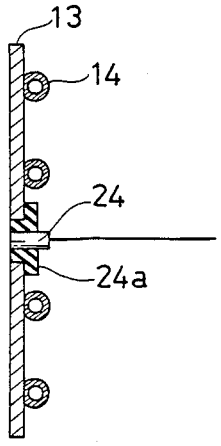
FIG. 10 is a view in section taken along the line X—X in FIG. 9.

FIG. 8 is a block diagram showing a first embodiment of control system for the refrigerator of FIG. 1. The diagram shows a switch 21 for initiating the refrigerator into usual operation, a thermostat 22 provided inside the freezer compartment, and a driver 23 for driving the compressor 4 and the fan 8*a*. When the switch 21 is turned on, the refrigerant is supplied to the first cooler 8, and the air cooled by the first cooler 8 is circulated through the storage compartment 2 and the freezer compartment 3. In response to a signal from the thermostat 22, the driver 23 turns on and off the compressor 4 and the fan 8*a* to maintain the temperature of the cold air circulating through the storage compartment 2 and the freezer compartment 3 at the set value of the thermostat 22. The rate of cold air supply to the storage compartment 2 is controlled by a damper thermostat (not shown) provided at a cold air inlet for the storage compartment 2. A sensor 24 detects the temperature of food placed on the second cooler 10, at 25 a quick freezing switch. Element 26 is a means for setting the temperatures of −1° C. (30.2° F.), −5° C. (23° F.) and −15° C. (5° F.). A comparator 27 compares the temperature detected by the sensor 24 with the temperature set by the setting means 26. A timer 28 is adapted to start measuring time upon the actuation of the switch 25. A controller 29 controls the driver 23 to bring the compressor 4 into continuous operation (disregarding the operation of the thermostat 22) and for operating the valve 7 in response to the outputs from the comparator 27 and the timer 28. The timer 28 can also start measuring time upon output signals of the controller 29. The components of the system which are surrounded by a dotted line are formed of a one-chip microcomputer. FIG. 9 is a plan view showing the second cooler equipped with the temperature sensor 24, and FIG. 10 is a view in section taken along the line X—X in FIG. 9. The temperature sensor 24 may comprise a thermistor, semiconductor sensor or thermocouple and is fixed to the center of the sheet 13 by a heat insulating member 24a as exposed from the sheet surface so as to detect the temperature by direct contact with the food.

The temperature sensor 24 may be attached to the rear side of the sheet 13. Alternatively, the sensor 24 may be of a noncontact type, such as an infrared temperature sensor. For temperature control using any sensor 24 for detecting the temperature of the cooling plate or of the surface of food, it is necessary to establish in advance the correlation between detected temperatures of various foods and the average temperature of the foods and calculate the average food temperature from the output of the sensor 24.

Figure 11:
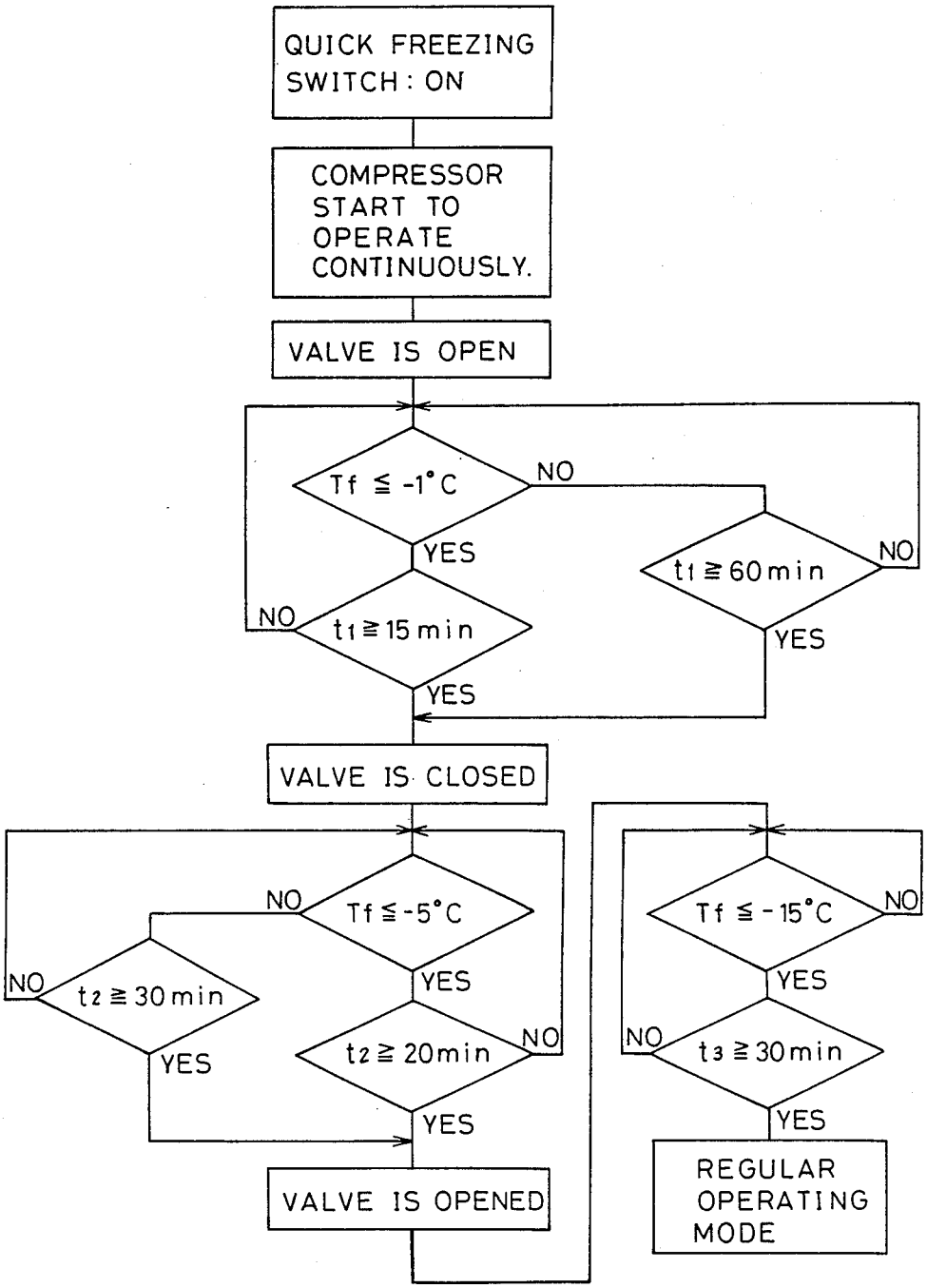
FIG. 11 is a flow chart illustrating the operation of the control system of FIG. 8.

FIG. 11 is a flow chart showing the operation of the control system of FIG. 8. When the quick freezing switch 25 is turned on, the refrigerator is switched to the quick freezing operation mode, with the compressor 4 forcibly brought into continuous operation while disregarding the signal from the thermostat 22 in the refrigerator. As in the usual operation, the valve 7 is held open for the air chilled by the first cooler 8 to refrigerate the food to be frozen and placed on the second cooler 10. When the temperature of the food detected by the sensor 24 is found to be −1° C. upon lapse of at least 15 minutes after the start of quick freezing operation (time t1), the valve 7 is closed to pass the refrigerant through the second cooler 10 and quickly refrigerate the food by contact with the second cooler 10 at a low temperature (−55° C.). Incidentally, even if the food temperature Tf has not been lowered to −1° C., the valve 7 is closed upon the time t1 exceeding 60 minutes. The valve 7 is opened again when the food temperature Tf detected by the sensor 24 has reached −5° C., with the time t2 since the closing of the valve 7 exceeding 20 minutes, or upon the time t2 exceeding 30 minutes even if the food temperature is higher than −5° C., to resume refrigeration with cold air using the first cooler 8. The refrigerator is then held in operation in this state. The quick freezing operation mode is completed when the food temperature Tf detected by the sensor 24 has reached −15° C., or when the time t3 lapsed since the reopening of the valve 7 exceeding 30 minutes, and the compressor 4 is brought out of the forced continuous operation into the usual operation.

The maximum operating time of 30 minutes was determined by experiments as a maximum period during which the rise of temperature of the storage compartment is within the allowable range (2.5° C.) at the highest ambient temperature of 30° C. (86° F.). The minimum operating time periods of 15 minutes, 20 minutes and 30 minutes in the steps involved were determined also through experiments with various foods as sufficient quick freezing operating time even if the food is in a small size or quantity or even if the sensor 24 fails to operate fully satisfactorily. Further the maximum operating time t1 of 60 minutes was determined similarly also through experiments to avoid unnecessary operation for a prolonged period of time. However, these time values are variable with variations in the size of the refrigerator, the capacity of the compressor, heat insulating characteristics, etc.

Figure 12:
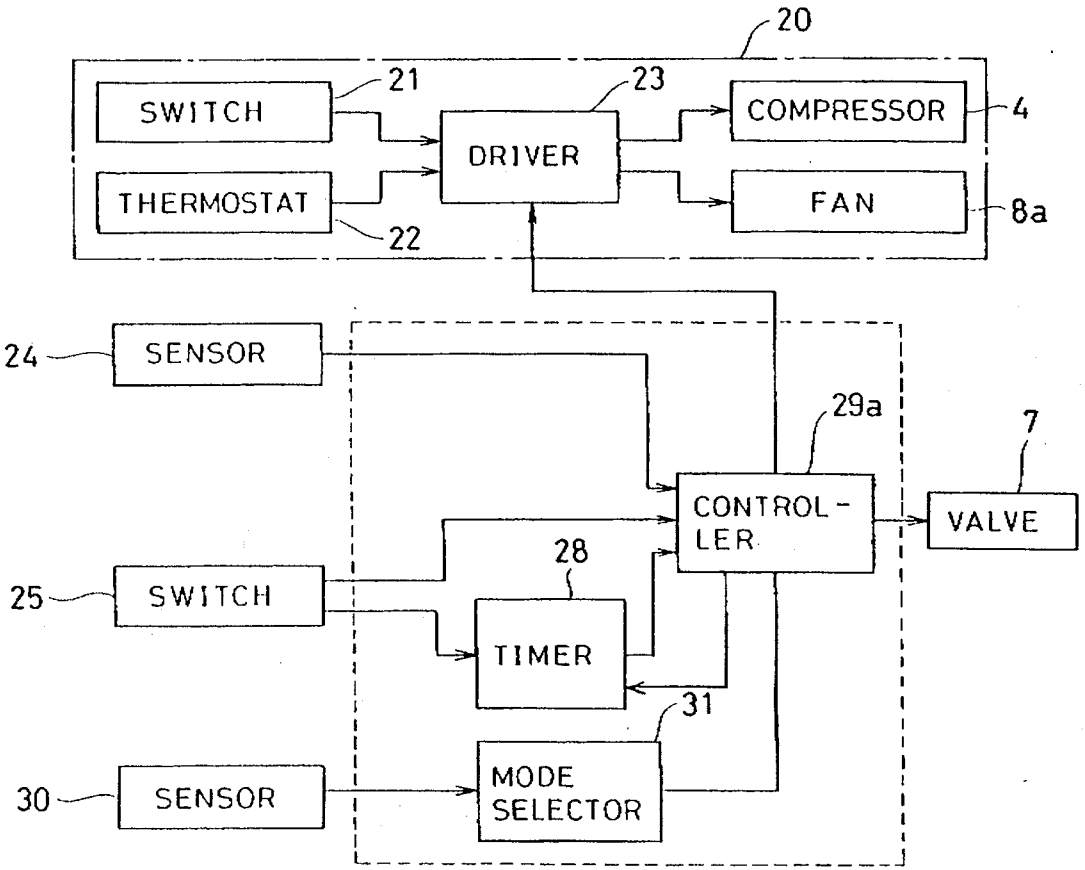

FIG. 12 is a block diagram showing a second embodiment of a control system for the refrigerator of FIG. 1. With reference to this drawing, a temperature sensor 30 (thermistor) is provided at a suitable location on the outer wall, door, bottom or upper portion of the refrigerator for detecting the ambient temperature, a mode selector 31 is provided for selecting an operation mode corresponding to the ambient temperature Ta from among the modes A, B and C listed in Tables 3 and 4, and a controller 29a is provided for causing the driver 23 to forcibly bring the compressor 4 into continuous operation upon the actuation of the switch 25 and for operating the valve 7 in response to outputs from the timer 28 and the mode selector 31. The other components are equivalent to the respective corresponding components

TABLE 3

| Mode | Ambient temp. (Ta) | Operating time Q1 | Operating time Q2 |
|---|---|---|---|
| A | Ta ≧ 20° C. (68° F.) | Until Tf = −1° C. (minimum 15 min, maximum 60 min) | Until Tf = −5° C. minimum 20 min maximum 30 min |
| B | 10° C. < Ta < 20° C. (50° F.) (68° F.) | | Until Tf = −5° C. minimum 20 min maximum 60 min |
| C | Ta ≦ 10° C. (50° F.) | | Until Tf = −5° C. minimum 20 min maximum 100 min |

Q1: Cooling with the first cooler
Q2: Cooling with the second cooler
Tf: Temperature of food

TABLE 4

| Mode | Ambient temp. (Ta) | Operating time Q1 | Operating time Q2 |
|---|---|---|---|
| A | Ta ≧ 20° C. (68° F.) | Until Tf = −1° C. (30.2° F.) | 30 min |
| B | 10° C. < Ta < 20° C. (50° F.) (68° F.) | (minimum 30 min) | 60 min |
| C | Ta ≦ 10° C. (50° F.) | — | 60 min |

Figure 13:
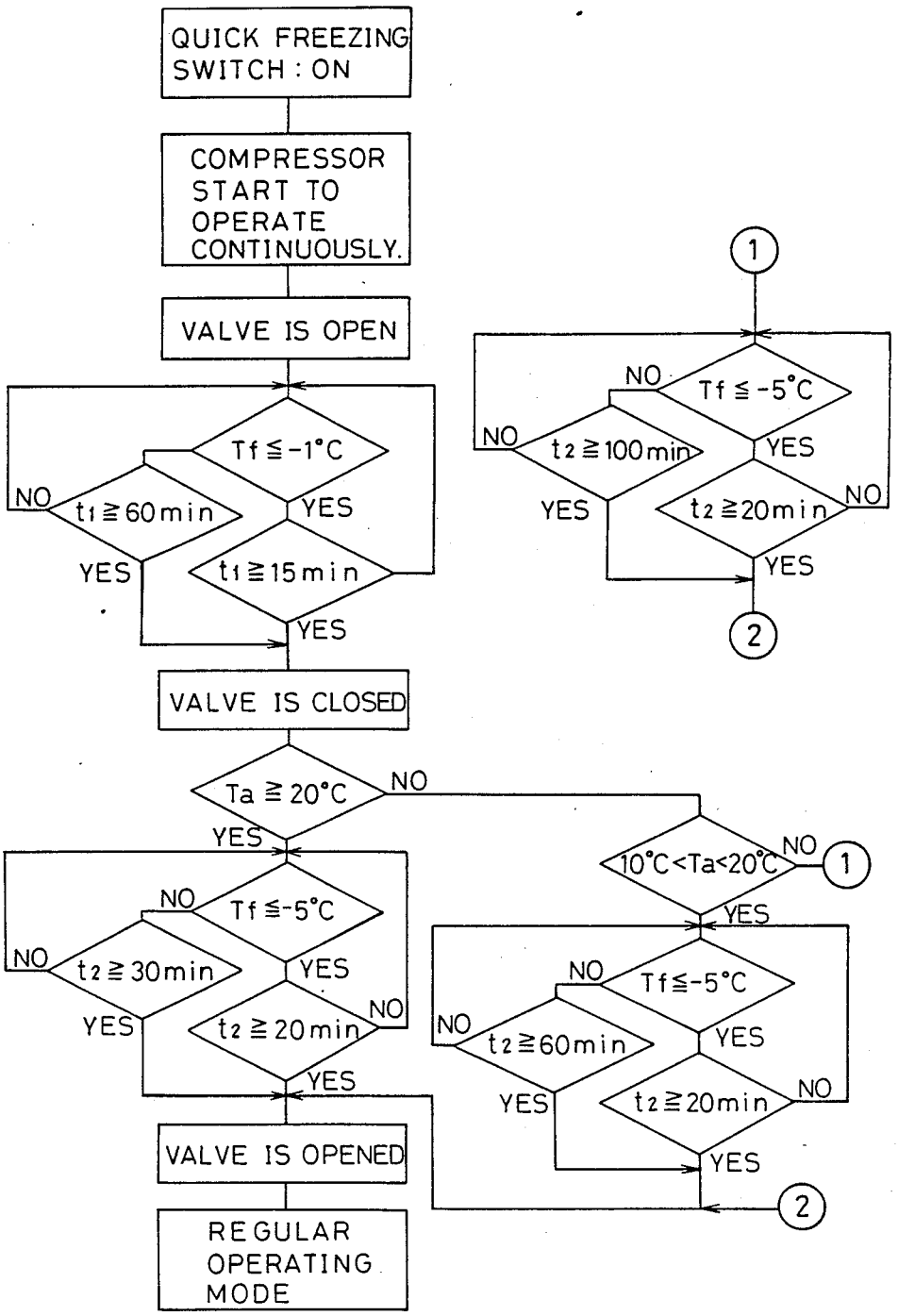
FIGS. 13 and 14 are flow charts showing the operation of the control system of FIG. 12.

Q1: Cooling with the first cooler
Q2: Cooling with the second cooler
Tf: Temperature of food FIG. 13 is a flow chart showing the control system of FIG. 12 in the respective modes given in Table 3. The quick freezing switch 25, when actuated, initiates the compressor 4 into continuous operation, with the valve 7 in its open position as in the usual operation. First, the food on the second cooler 10 is chilled with cold air from the first cooler 8. The valve 7 is closed when the food temperature Tf has dropped to a level not higher than −1° C. (30.2 F.) with the time t1 since the actuation of the switch 25 exceeding 15 minutes, or upon the time t1 exceeding 60 minutes even if Tf is higher than −1° C., to cause the refrigerant to flow into the second cooler 10 and quickly freeze the food. When Tf has reached −5° C. and a lower level with the time t2 since the closing of the valve 7 exceeding 20 minutes, the valve 7 is opened, and at the same time, the compressor 4 is brought out of forced continuous operation into the usual operation. In this case, however, upon the time t2 exceeding a specified period longer than 20 minutes before Tf reaches −5° C., the valve 7 is opened to subsequently conduct the usual operation since the internal temperature of the refrigerator rises greatly if the valve 7 is further held closed. The above-mentioned specified period is 30 minutes, 60 minutes or 100 minutes when the ambient temperature Ta is in the range of Ta≧20° C., 10° C.<Ta<20° C. or Ta≦10° C., respectively. In the above procedure, the compressor 4 may be held in the forced continuous operation for a short period of time after the valve 7 has been opened as seen in FIG. 11 to refrigerate the food with the first cooler 8.

Figure 14:
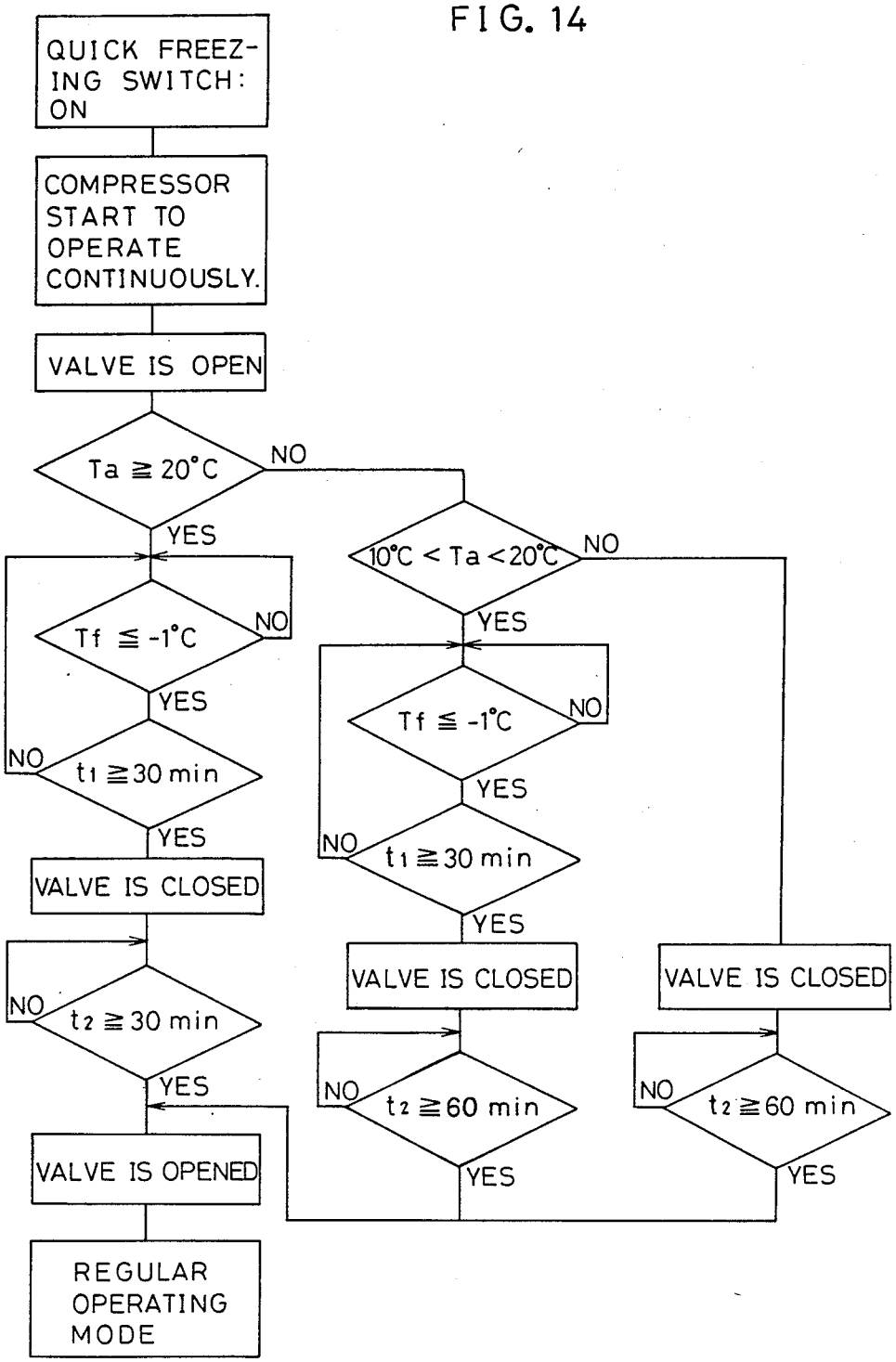

FIG. 14 is a flow chart showing the control system of FIG. 12 in the respective modes listed in Table 4. The quick freezing switch 25, when actuated, initiates the compressor 4 into continuous operation, with the valve 7 in its open position as in the usual operation. When the ambient temperature Ta is at least 20° C. (68° F.) (Mode A), the food on the second cooler 10 is first chilled with cold air from first cooler 8. The valve 7 is closed when the food temperature Tf has lowered to a level not higher than −1° C. (30.2° F.) with the time t1 since the actuation of the switch 25 exceeding 30 minutes to permit the refrigerant to flow into the second cooler 10 and quickly freeze the food. Upon the time t2 since the closing of the valve 7 exceeding 30 minutes, the valve 7 is opened, and at the same time, the compressor 4 is brought out of forced continuous operation into the usual operation. Next, when Ta is in the range of 10° C. (50° F.)<Ta<20° C. (68° F.), i.e. in Mode B, the food is refrigerated with the first cooler 8 until Tf≦−1° C. and t1≧30 minutes as stated above. The valve 7 is thereafter closed, causing the second cooler 10 to quickly freeze the food for only 60 minutes. If Ta≦10° C. (50° F.), i.e. in Mode C, the valve 7 is closed with actuation of the switch 25 to refrigerate the food with the second cooler 10 for 60 minutes only.

Figure 15:
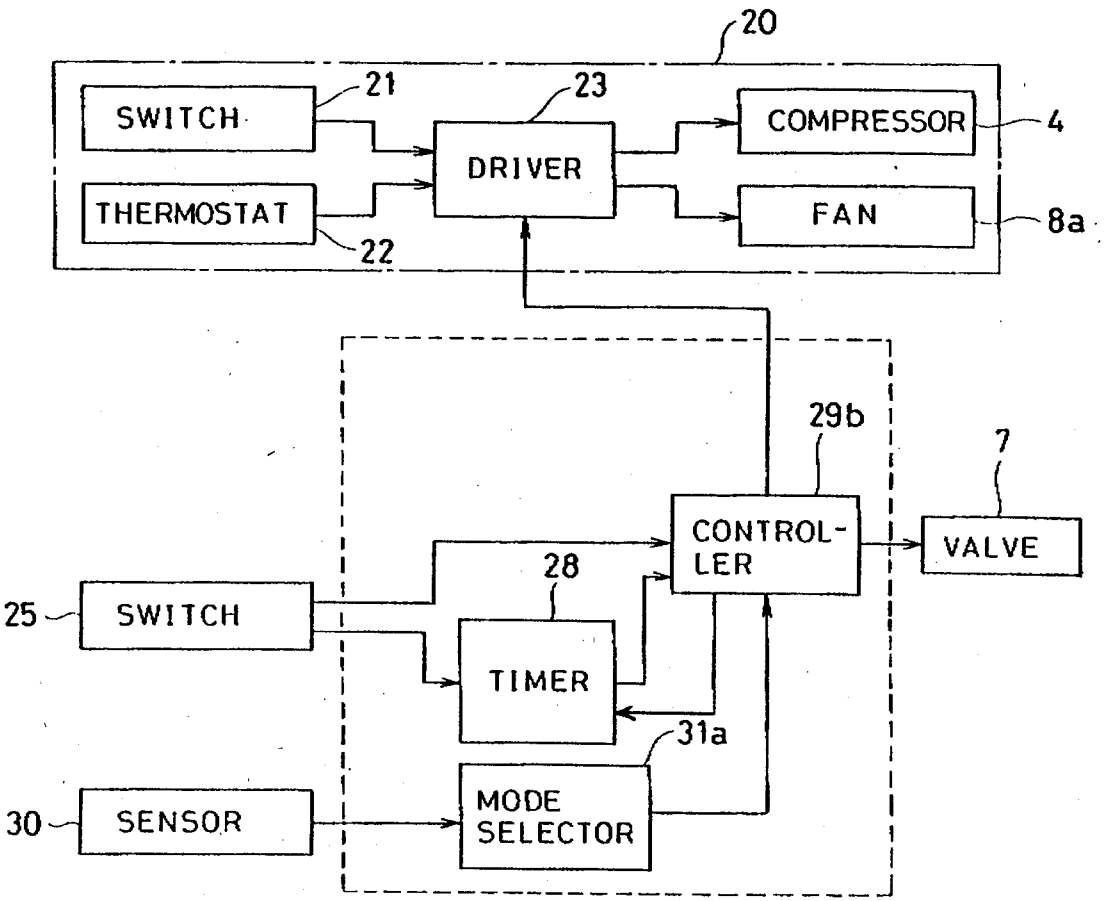

FIG. 15 is a block diagram showing a third embodiment of control system for the refrigerator of FIG. 1. With reference to the diagram, indicated at **31*a* is a mode selector for selecting an operation mode corresponding to the ambient temperature Ta from among the modes A, B and C listed in Table 5, and at 29*b* a controller for causing the driver 23 to forcibly bring the compressor 4 into continuous operation upon the actuation of the switch 25 and for operating the valve 7 in response to outputs from the timer 28 and the mode selector 31*a*. This control system is equivalent to the control system of FIG. 12 with the temperature sensor 24 removed therefrom and is adapted to control the operating time only in accordance with the ambient temperature Ta. More specifically, when the ambient temperature detected is higher, the direct cooling plate is operated for a shorter period of time, whereas if the ambient temperature is lower, the plate is operated for a longer period of time, by changing the operation mode. Thus, the second cooler 10** is operated for quick freezing for the longest possible period, whereby food can be frozen quickly and effectively while the internal temperature of the refrigerator is also effectively prevented from rising.

TABLE 5

| Mode | Ambient temp. (Ta) | Operating Time (min) Q1 | Q2 | Q3 |
|---|---|---|---|---|
| A | Ta ≧ 20° C. (68° F.) | 40 | 30 | 40 |
| B | 10° C. < Ta < 20° C. (50° F.) (68° F.) | 20 | 60 | 40 |
| C | Ta ≦ 10° C. (50° F.) | — | 90 | — |

Q1: Cooling with the first cooler
Q2: Cooling with the second cooler
Q3: Cooling with the first cooler after Q2

Figure 16:
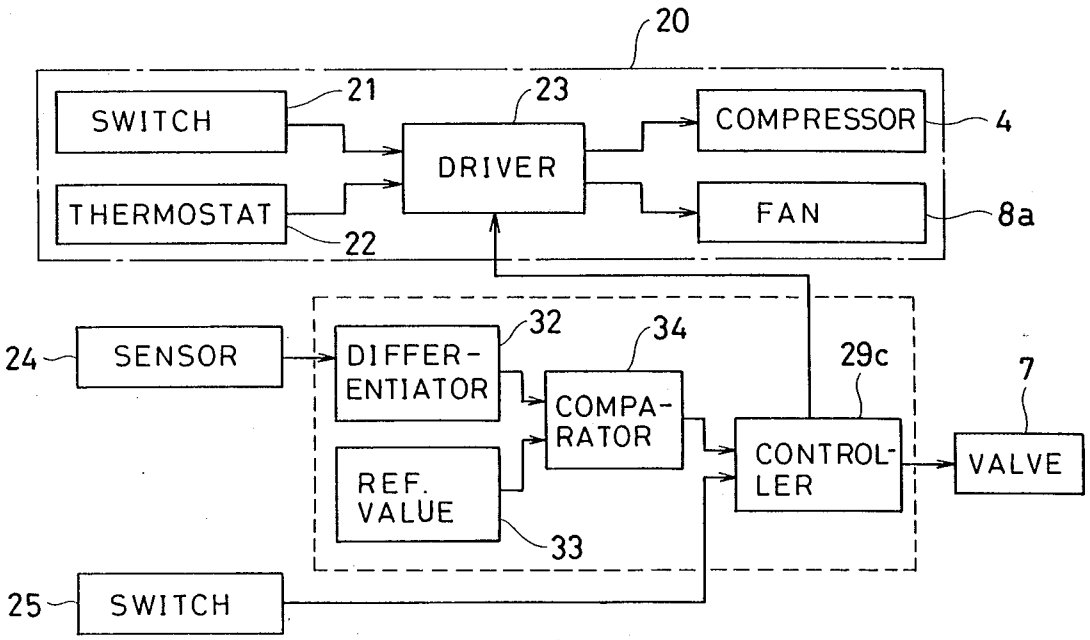

FIG. 16 is a block diagram showing a fourth embodiment of control system for the refrigerator shown in FIG. 1. With reference to the diagram a differentiator 32 is provided for calculating the rate of variation in temperature relative to time from the temperature of the food on the second cooler 10 detected by the sensor 24, a means for setting predetermined values 33 is provided, and a comparator 34 is provided for comparing the rate of temperature variation with the predetermined value. The circuit 20 shown is equivalent to the one shown in FIG. 8. Further, a controller **29*c* for causing the driver 23 to bring the compressor 4 into forced continuous operation upon the actuation of the switch 25 and for operating the valve 7 in response to an output from the comparator 34**.

When the quick freezing switch 25 is closed with food placed on the second cooler 10, the valve 7 is held open, and the compressor 4 and the cold air circulating fan **8*a* are driven continuously. At this time, the refrigerator has not been in full quick freezing operation, and the interior is cooled more rapidly than in usual operation since the compressor 4 and the fan 8*a*** are in continuous operation.

On the other hand, the temperature sensor 24 detects the temperature of the food which varies incessantly, converts the variations into an electric signal and feeds the signal to the differentiator 32, which calculates the temperature gradient of the food. The comparator 34 compares the gradient with the set value to detect whether the food has been brought into the zone of maximum ice crystal formation. As seen in FIG. 7, the temperature gradient relative to time is smallest in this zone.

Upon the comparator 34 detecting that the food is in the above zone, the controller **29*c* initiates the refrigerator into a full quick freezing operation (real quick freezing operation) by closing the valve 7, stopping the fan 8*a* and bringing the compressor 4 into continuous operation. Consequently, the refrigerant from the first capillary tube 6 wholly flows through the second capillary tube 9 into the second cooler 10, lowering the surface temperature thereof to about −55° C., with the result that the food on the second cooler 10** is quickly refrigerated to pass through the zone and becomes frozen.

Thus according to the invention, food passes through the zone of maximum ice crystal formation within a very short period of time, and is therefore less likely to have its cells broken and preservable for a prolonged period of time without impairing its taste.

If the internal temperature variation is likely to exceed the limited range, the duration of refrigeration with the second cooler is limited by the control system as in the foregoing embodiments.

The circuit surrounded by the dotted line in FIGS. 12, 14 or 15, like the one shown in FIG. 8, is formed of a one-chip microcomputer.

What is claimed is:

1. A refrigeration device comprising:

a compartment, a refrigeration cycle comprising a compressor, a condenser, a first capillary tube and a first cooler connected with a refrigerant channel into a loop for circulating a refrigerant therethrough, a quick freezing refrigerant circuit connected in parallel with the first cooler and comprising a second capillary tube and a second cooler connected in series therewith, the circuit having a junction for connection to the refrigerant channel from the first capillary tube to the first cooler, a change-over valve provided in the refrigerant channel between the junction and the first cooler inclusive of the junction for changing a flow of the refrigerant toward the first cooler to a flow of the refrigerant toward the second cooler, means for supplying air cooled by the first cooler to the compartment, and control means for driving the compressor, the means for supplying air and the change-over valve, control means for driving the compressor, the fan and the change-over valve, the second cooler being disposed within the compartment, the refrigerant being supplied to the first cooler for usual refrigeration to cool the compartment, the refrigerant being supplied to the second cooler for quick freezing to freeze an article to be frozen in contact with the second cooler, said control means including, a temperature sensor for detecting the temperature of the article, a comparator for comparing the temperature of the article with a set value, a timer, and a controller for controlling the change-over valve based on the result of comparison by the comparator and the time measured by the timer, said controller controls the change-over valve so as to supply the refrigerant to the first cooler when the temperature of the article is not lower than a first set value, to supply the refrigerant to the second cooler when the temperature is between the first set value and a second set value which is lower than the first value, or to supply the refrigerant to the first cooler when the temperature is not higher than the second set value.

2. A refrigeration device as defined in claim 1 wherein the quick freezing refrigerant circuit is provided with a check valve for preventing a reverse flow.

3. A refrigeration device as defined in claim 1, wherein the controller controls the change-over valve so as to supply the refrigerant to the second cooler when the temperature of the article lowers to below the first set value or when the period of supply of the refrigerant to the first cooler exceeds a specified period of time measured by the timer.

4. A refrigeration device, as defined in claim 1 wherein the controller controls the change-over valve so as to supply the refrigerant to the second cooler when the temperature of the article lowers to below the first set value, with the period of supply of the refrigerant to the first cooler exceeding a specified period of time measured by the timer.

5. A refrigeration device as defined in claim 1 wherein the controller controls the change-over valve so as to supply the refrigerant to the first cooler when the temperature of the article lowers to a level not higher than the second set value or when the period of supply of the refrigerant to the second cooler exceeds a specified period of time measured by the timer.

6. A refrigeration device as defined in claim 1 wherein the controller controls the change-over valve so as to supply the refrigerant to the first cooler when the temperature of the article lowers to a level not higher than the second set value, with the period of supply of the refrigerant to the second cooler exceeding a specified period of time measured by the timer.

7. A refrigeration device as defined in claim 1 wherein the second cooler is in the form of a flat plate.

8. A refrigeration device defined in claim 1 wherein the temperature sensor is a temperature-sensitive element mounted on the second cooler for detecting the temperature of the article in contact therewith.

9. A refrigeration device as defined in claim 1 wherein the temperature sensor is an infrared temperature sensor.

10. A refrigeration device as defined in claim 1 wherein the second cooler is coated with a deicing film over the exposed surface thereof.

11. A refrigeration device as defined in claim 10 wherein the deicing film is a fluorocarbon resin film.

12. A refrigeration device as defined in claim 10 wherein the deicing film is a silicone resin film.

13. A refrigeration device as defined in claim 7 wherein the cooler in the form of a flat plate is provided with a fluorocarbon resin film over the surface thereof.

14. A refrigeration device as defined in claim 1 wherein the control means comprises a microcomputer.

15. A refrigerator as defined in claim 7 wherein the cooler in the form of a flat plate is provided with a silicone resin film over the surface thereof.

16. A refrigeration system for cooling foods comprising:

a compressor;

a primary refrigeration circuit, driven by said compressor, for cooling the food by developing chilled air to be provided in proximity to said food;

quick freezing means, driven by said compressor, having a chilled plate for cooling food placed on said plate by direct conduction therewith;

means for selectively coupling only said quick freezing means to said compressor to enable drive of only said quick freezing means thereby; and control means for controlling operation of said means for coupling, said control circuit means sensing the temperature of any food placed on said chilled plate and controlling said means for coupling to couple said quick freezing means to said compressor only during a zone of maximum ice crystal formation.

17. The refrigeration system of claim 16 wherein said zone of maximum ice crystal formation occurs between −1° C. and −5° C.

18. The refrigeration system of claim 16 wherein said zone of maximum ice crystal formation is a temperature range where the food has a maximum resistance to temperature change.

19. The refrigeration system of claim 18 further comprising:

temperature sensing means for sensing the temperature of said food; and control means, responsive to the temperature sensed by said temperature sensing means, for monitoring the rate of change of the sensed temperature and for controlling said control valve in response thereto, said control means closing said control valve to interrupt the flow to said primary evaporator when the rate of change of said sensed temperature falls below a predetermined level; thereby indicating entry into the zone of maximum ice crystal formation.

20. A method of freezing a food comprising the ordered steps of:

(a) cooling the food by cooling the air around the food until the food approaches a zone of maximum ice crystal formation;

(b) cooling the food by cooling a plate directly contacting said food substantially only during the zone of maximum ice crystal formation; and (c) cooling the food to a desired temperature below the zone of maximum ice crystal formation by resumption of the cooling of the air around the food.

21. The method of claim 20 wherein the zone of maximum ice crystal formation occurs between −1° C. and −5° C.

22. The refrigeration system of claim 20, wherein said zone of maximum ice crystal formation is a temperature range where the food has a maximum resistance to temperature change.

23. The method of claim 22 wherein the zone of maximum ice crystal formation occurs between −1° C. and −5° C.

24. A method of freezing a food comprising the ordered steps of:

(a) cooling the food by only cooling the air around the food until the food approaches a zone of maximum ice crystal formation;

(b) cooling the food by cooling a plate directly contacting said food substantially only during the zone of maximum ice crystal formation; and (c) cooling the food to a desired temperature below the zone of maximum ice crystal formation only by resumption of the cooling of the air around the food.

25. The method of claim 24 wherein the zone of maximum ice crystal formation occurs between −1° C. and −5° C.

26. The method of claim 24 wherein said zone of maximum ice crystal formation is a temperature range where the food has a maximum resistance to temperature change.

27. The method of claim 26 further comprising the steps of:

sensing the temperature of said food;

determining the rate of change of the food temperature; and switching from step (a) of cooling to step (b) of cooling when the determined rate of change of food temperature falls below a predetermined level, indicating that the zone of maximum ice crystal formation has been reached; and switching from step (b) of cooling to step (c) of cooling when the determined rate of change of food temperature rises above the predetermined level, indicating that the temperature of the food has been lowered below the zone of maximum ice crystal formation.

28. The method of claim 24 further comprising:

directly sensing the temperature of the food; and switching between steps a–c of cooling in dependence on the sensed temperature of the food.

29. The method of claim 24 wherein said steps (a) and (c) of cooling comprise circulating refrigerated air about said food.

30. The refrigeration device of claim 1 wherein the first set value is −1° C. and the second set value is −5° C.

* * * * *